US008851312B2

(12) United States Patent
Itokawa et al.

(10) Patent No.: US 8,851,312 B2
(45) Date of Patent: Oct. 7, 2014

(54) SYNTHETIC RESIN BOTTLE WITH A HANDLE

(75) Inventors: Junichi Itokawa, Tokyo (JP); Yoshinori Matsuo, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 1160 days.

(21) Appl. No.: 12/593,697

(22) PCT Filed: Mar. 26, 2008

(86) PCT No.: PCT/JP2008/055775

§ 371 (c)(1),
(2), (4) Date: Mar. 24, 2010

(87) PCT Pub. No.: WO2008/123322

PCT Pub. Date: Oct. 16, 2008

(65) Prior Publication Data

US 2011/0315653 A1 Dec. 29, 2011

(30) Foreign Application Priority Data

Mar. 30, 2007 (JP) ..... 2007-094826
Mar. 30, 2007 (JP) ..... 2007-094827
Apr. 27, 2007 (JP) ..... 2007-119662

(51) Int. Cl.
*B65D 23/10* (2006.01)

(52) U.S. Cl.
CPC ..... *B65D 23/106* (2013.01)
USPC ..... 215/396; 220/756; 220/761; 220/770; 220/771

(58) Field of Classification Search
CPC ..... B65D 23/106
USPC ..... 215/395, 396, 397, 398; 220/696, 220/710.5, 752, 760, 761, 741, 753, 755, 220/756, 770, 771
See application file for complete search history.

(56) References Cited

U.S. PATENT DOCUMENTS 4,596,337 A * 6/1986 Gerold et al. ..... 215/398
4,964,522 A * 10/1990 Umetsu et al. ..... 215/398
5,115,940 A * 5/1992 Friedman ..... 220/737
5,560,506 A * 10/1996 Yanagisawa et al. ..... 215/398

(Continued)

FOREIGN PATENT DOCUMENTS

JP U-64-009135 1/1989
JP A-10-250738 9/1998

(Continued)

*Primary Examiner* — Robert J Hicks
*Assistant Examiner* — Kareen Rush
(74) *Attorney, Agent, or Firm* — Oliff PLC

(57) ABSTRACT

Pinhole detection is achieved when pinholes happen to develop near stoppers used to fit a handle. A biaxially drawn synthetic resin bottle has a recessed portion, and a synthetic resin handle, fitted in an undercut engagement to the recessed portion by insert molding. The handle comprises upper and lower fitting arms disposed at a grip in a vertically long plate shape. Both arms extend forward from the grip. A stopper extends upward from a front end of the upper fitting arm, and a stopper extends upward and/or downward from a front end of the lower fitting arm. A ridge or groove is formed extending rearward of a stopper of either arm, along a top surface of the upper fitting arm or along a top surface and/or an underside surface of the lower fitting arm. A connecting passage for air release is formed along the ridge/groove.

7 Claims, 19 Drawing Sheets

(56) References Cited

U.S. PATENT DOCUMENTS

| | | | | |
|---|---|---|---|---|
| 5,819,966 | A * | 10/1998 | Ota et al. | 215/398 |
| D414,109 | S * | 9/1999 | Ota et al. | D9/434 |
| 6,012,597 | A * | 1/2000 | Nishihara et al. | 215/398 |
| D421,386 | S * | 3/2000 | Ota et al. | D9/434 |
| 6,179,143 | B1 * | 1/2001 | Grob | 215/398 |
| 6,460,715 | B1 * | 10/2002 | Yonemori et al. | 215/396 |
| 6,855,289 | B2 * | 2/2005 | Krishnakumar et al. | 264/516 |
| 7,108,146 | B2 * | 9/2006 | Itokawa et al. | 215/398 |
| 7,185,777 | B2 * | 3/2007 | Itokawa et al. | 215/398 |
| 7,481,326 | B2 * | 1/2009 | Itokawa et al. | 215/398 |
| 2001/0042731 | A1 * | 11/2001 | Itokawa et al. | 215/398 |
| 2005/0115919 | A1 * | 6/2005 | Itokawa et al. | 215/398 |
| 2006/0011574 | A1 * | 1/2006 | Itokawa et al. | 215/398 |

FOREIGN PATENT DOCUMENTS

| | | |
|---|---|---|
| JP | A-2001-072070 | 3/2001 |
| JP | A-2001-341745 | 12/2001 |
| JP | A-2002-029543 | 1/2002 |
| JP | A-2004-131097 | 4/2004 |

* cited by examiner (a)

(b)

(a)

(b)

(a)

(b)

(a)

(b)

SYNTHETIC RESIN BOTTLE WITH A HANDLE

TECHNICAL FIELD

This invention relates to a synthetic resin bottle with a handle formed by utilizing an insert molding process in which the handle is fitted firmly to a biaxially drawn, blow molded bottle in an undercut engagement.

BACKGROUND ART

For example, Patent Document 1 describes a process for preparing large-size synthetic resin bottles with a handle, such as PET bottles, obtained by fitting a handle to each bottle molded separately. The handle is injection molded and is used as an insert. The handle has a grip, a pair of fitting arms extending frontward from upper and lower ends of the grip, and a stopper disposed at the front of each arm. The handle is fitted to the bottle firmly in the undercut engagement using the stoppers, at the time when the bottle is biaxially drawn and blow molded. This so-called insert molding process is widely in use, Patent Document 1: JP2001-341745

DISCLOSURE OF THE INVENTION

Problems to be Solved by the Invention

The process for biaxial drawing and blow molding to prepare synthetic resin bottles is generally accompanied by a last inspection step for checking on the existence or lack of any pinholes by means of pressurized air under a neck-sealed condition. Especially in the case of the above-described synthetic resin bottles with a handle of the type fitted firmly in the undercut engagement using stoppers in the insert molding process, there is growing probability of pinhole development because the resin may be broken when it is drawn and become quite thin in the vicinities of the forefronts of these stoppers.

However, even if some pinholes have developed, the peripheries of the pinholes may come in tight contact or become molten with the surfaces of the insert molded handle. In that case, the pinholes might not be detected in the above-described inspection step.

A technical problem to be solved by this invention is to ensure that the pinholes, if any, can be detected when these pinholes develop near the stoppers used to fit the handle to the bottle in the undercut engagement. An object of this invention is to provide a synthetic resin bottle with a handle without any concern for the pinholes.

Means of Solving the Problem

The means of carrying out the invention of claim 1 to solve the above-described technical problem comprises:

- a synthetic resin bottle, which is a biaxially drawn, blow molded product and has a recessed portion disposed at the rear of a body thereof, and
- a synthetic resin handle, which is fitted in an undercut engagement to the above recessed portion by an insert molding process, said handle comprising:
  - an upper fitting arm and a lower fitting arm disposed at an upper end and a lower end, respectively, of a grip in a vertically long plate shape so that both arms extend forward from the grip,
  - a stopper extending upward from a front end of the upper fitting arm, and
  - a stopper extending upward and/or downward from a front end of the lower fitting arm,
- wherein a ridge or groove is formed so that it extends rearward from behind a base of at least a stopper of either the upper or lower fitting arm: (i) along a top surface of the upper fitting arm; (ii) along a top surface or an underside surface of the lower fitting arm; (iii) along each of the top surface and the underside surface of the lower fitting arm; (iv) along the top surface of the upper fitting arm, with another ridge or groove along the top or underside surface of the lower fitting arm; or (v) along the top surface of the upper fitting arm, with two more ridges or grooves along the top and underside surfaces of the lower fitting arm, and
- wherein a connecting passage or passages for air release is/are formed along the ridge or through the groove, by utilizing a space or spaces formed between a body wall and the ridge or groove.

Under this construction of claim 1, the handle is provided with a stopper extending upward from the top surface of the upper fitting arm and with another stopper extending downward from the underside surface, and/or upward from the top surface, of the lower fitting arm. High fitting strength can be obtained without any rattling movement, by fitting these stoppers firmly in the undercut engagement to an upper end and a lower end of the recessed portion of the body in the insert molding process.

However, it is preferred that the stoppers have a projecting height of several millimeters to obtain sufficient fitting strength. During the blow molding step, the drawn and deforming resin bumps at first into the forefronts of the stoppers. Then, the resin climbs over the top portion of the stoppers and goes around to their back surface. Finally, the resin touches down on the top surface of the upper fitting arm or on the top surface and/or underside surface of the lower fitting arm.

During this process step, the drawn and deforming resin may happen to be hooked at the top portion of each stopper. Thus, pinholes may develop over an area ranging from this top portion to the top surface of the upper fitting arm or to the top surface and/or the underside surface of the lower fitting arm.

Under the above construction of claim 1, a ridge or groove is formed so that it extends rearward from behind the base of at least a stopper of either the upper or lower fitting arm: (i) along a top surface of the upper fitting arm; (ii) along a top surface or an underside surface of the lower fitting arm; (iii) along each of the top and underside surfaces of the lower fitting arm; (iv) along the top surface of the upper fitting arm, with another ridge or groove along the top surface or the underside surface of the lower fitting arm; or (v) along the top surface of the upper fitting arm, with two more ridges or grooves along the top and underside surfaces of the lower fitting arm. The resin is drawn and deformed so as to climb over the top portion of the stoppers and to go around to their back surfaces. In an area where the ridge(s) or groove(s) is/are formed, the resin does not exactly trace the shape of the ridge or groove because of a strain hardening effect involved in drawing and deformation. In the case of a ridge, there remain spaces between the resin and both sides of the ridge. In the case of a groove, it is covered with the resin, and there remains a space inside the groove. Apart from these remaining spaces, the resin comes in tight contact with the top surface of the upper fitting arm or with the top surface and/or the underside surface of the lower fitting arm.

The spaces thus formed on both sides of the ridge or the space inside the groove serves as a connecting passage or passages running along the ridge or through the groove. Even if pinholes may have developed over an area ranging from the top portion of a stopper to the top surface of the corresponding upper fitting arm or the top surface and/or the underside surface of the corresponding lower fitting arm, the passage(s) would perform an air release function as the pinholes are connected to outside air through the passage(s), and therefore, with the neck kept sealed, any pinholes can be detected reliably by means of pressurized air.

When the bottle is blow molded, the resin is expanded and deformed to a great extent along the top surface of the upper fitting arm or along the top surface and/or the underside surface of the lower fitting arm in the rearward direction from the forefront of each arm. However, since the ridge(s) or the groove(s) is/are formed in the direction of drawing progress, the resin is smoothly drawn without being distracted by the ridge(s) or the groove(s).

The ridge(s) or the groove(s) is/are formed so as to extend rearward from closely behind the base of the stoppers along the top surface of the upper fitting arm or along the top surface and/or the underside surface of the lower fitting arm. However, if necessary, the front end of the ridge or the groove can be extended to the back surface of each stopper. The position of a rear end of the ridge or the groove can be determined within a range in which the air release function may be fully performed during the insert molding step, while taking into consideration a range in which the stoppers come in contact with the bottle.

In conformity with the shape of the recessed portion of the bottle, the upper fitting arm and the lower fitting arm have a different shape, and there is also a difference in the incidence of pinhole development between them. Therefore, it is not necessary to form a ridge or a groove for the stoppers of both fitting arms. The ridge or the groove can be formed only for one of the fitting arms, thinking of whichever arm is more vulnerable to any pinhole development. Furthermore, considering the strength of the fitting arms and the strength of fitting to the recessed portion, one can form a ridge on one fitting arm and a groove on the other fitting arm, or alternatively one can take up a construction that both the ridge and the groove are formed on one fitting arm.

The means of carrying out the invention of claim 2 comprises that in the invention of claim 1, a ridge is formed so that it extends rearward from behind the base of at least a stopper of either the upper or lower fitting arm: (i) along a top surface of the upper fitting arm; (ii) along a top or underside surface of the lower fitting arm; (iii) along each of the top and underside surfaces of the lower fitting arm; (iv) along the top surface of the upper fitting arm, with another ridge along the top surface or the underside surface of the lower fitting arm; or (v) along the top surface of the upper fitting arm, with two more ridges along the top and underside surfaces of the lower fitting arm, and that connecting passages for air release are formed along this ridge or ridges.

A ridge is used in the above construction of claim 2 as a means of forming the connecting passages. The ridge is formed so that it extends rearward from behind the base of at least a stopper along the top surface of the upper fitting arm or along the top surface and/or the underside surface of the lower fitting arm. The expanding resin is drawn and deformed to climb over the top portion of each stopper and to go around to the back surface of the stopper. In the area where the ridge is formed, the resin at first comes in contact with the top of the ridge, goes around the ridge toward both sides of the ridge, and then comes in tight contact with the top surface of the upper fitting arm or the top surface and/or the underside surface of the lower fitting arm.

At the time when the resin deforms so as to go around a ridge toward the ridge sides, the resin does not trace the shape of the ridge exactly down to the base on both ridge sides because of the strain hardening effect involved in drawing and deformation, thus allowing for spaces to remain on both sides. Apart from these spaces between the resin and both sides of the ridge, the resin comes in tight contact with the top surface of the upper fitting arm or the top surface and/or the underside surface of the lower fitting arm. The spaces thus formed on both sides of the ridge serves as connecting passages running along the ridge. Even if pinholes may have developed over the area ranging from the top portion of a stopper to the top surface of the upper fitting arm or from the top and/or lowest portion of the stopper to the top surface and/or underside surface of the lower fitting arm, the passages would perform the air-release function as the pinholes are connected to outside air through the passage, and therefore, with the neck kept sealed, any pinholes can be detected reliably by means of pressurized air.

The ridge thus formed would be able to increase the strength of the fitting arms. When the bottle is blow molded, the expanding resin goes around the ridge toward the ridge sides after the resin has touched down on the top surface of the ridge although spaces are formed between the resin and the ridge sides. The ridge performs a locking function to prevent the bottle firmly from rattling especially in the lateral direction.

The means of carrying out the invention of claim 3 comprises that, in the invention of claim 2, the ridge has a cross-sectional shape of an inverted trapezoid in which lateral width is enlarged gradually from base toward the top surface.

Under the above construction of claim 3, the inverted trapezoidal shape having a larger lateral width at the top than at the base allows the ridge to have spaces securely between the resin and both ridge sides. These spaces serve reliably as the connecting passages for an air release purpose.

The means of carrying out the invention of claim 4 comprises that, in the invention of claim 1, a groove is formed so that it extends rearward from behind the base of at least a stopper of either the upper or lower fitting arm: (i) along the top surface of the upper fitting arm; (ii) along the top or underside surface of the lower fitting arm; (iii) along each of the top and underside surfaces of the lower fitting arm; (iv) along the top surface of the upper fitting arm, with another groove along the top or underside surface of the lower fitting arm; or (v) along the top surface of the upper fitting arm, with two more grooves along the top and underside surfaces of the lower fitting arm, and that a connecting passage or passages for air release is/are formed through this groove or grooves.

The groove is used under the above construction of claim 4 as a means of forming a connecting passage. The groove is formed so that it extends rearward along the top surface of the upper arm or along the top surface and/or the underside surface of the lower fitting arm, starting from behind the base of at least a stopper. The expanding resin is thus drawn and deformed to climb over the top portion of the stopper and to go around to the back surface of the stopper. Then, the resin comes in tight contact with the top surface of the upper fitting arm or the top surface and/or the underside surface of the lower fitting arm.

At that time, the resin is in a strain hardening state caused by drawing and deformation. In this state, the resin does not exactly trace the shape of the groove, but simply covers the groove and the surface of the fitting arm concerned. A space can be securely formed inside the groove covered with the resin.

The space inside the groove serves as a connecting passage running through the groove. Even if pinholes may have developed in the area ranging from the top portion of a stopper to the top surface of the upper fitting arm or to the top surface and/or the underside surface of the lower fitting arm, this connecting passage would perform an air release function as the pinholes are connected to outside air through the passage, and therefore, with the neck kept sealed, any pinholes can be detected reliably by means of pressurized air.

The means of carrying out the invention of claim 5 to solve the above-described technical problem comprises:

- a synthetic resin bottle, which is a biaxially drawn, blow molded product and has a recessed portion disposed at the rear of a body thereof, and
- a synthetic resin handle, which is fitted in an undercut engagement to the above recessed portion by an insert molding process, said handle comprising:
  - an upper fitting arm and a lower fitting arm disposed respectively at an upper end and a lower end of a grip in a vertically long plate shape so that both arms extend forward from the grip,
  - a stopper extending upward from a front end of the upper fitting arm, and
  - a stopper extending upward and/or downward from a front end of the lower fitting arm,
- wherein a transverse groove for air release is formed at a position closely behind a base of at least a stopper of either the upper or lower fitting arm so that the groove extends to both sides of a fitting arm: (i) across a top surface of the upper fitting arm; (ii) across a top or underside surface of the lower fitting arm; (iii) across each of the top and underside surfaces of the lower fitting arm; (iv) across the top surface of the upper fitting arm, with another groove across the top or underside surface of the lower fitting arm; or (v) across the top surface of the upper fitting arm, with two more grooves across the top and underside surfaces of the lower fitting arm.

Under the construction of claim 5, the handle is provided with a stopper extending upward from the top surface of the upper fitting arm and with another stopper extending downward from the underside surface, and/or upward from the top surface, of the lower fitting arm. High fitting strength can be obtained without any rattling movement, by fitting these stoppers firmly in the undercut engagement to an upper end and a lower end of the recessed portion of the body in the insert molding process.

However, it is preferred that the stoppers have a projecting height of several millimeters to obtain sufficient fitting strength. During a blow molding step, the expanding resin bumps at first into the forefronts of the stoppers. Then, the resin climbs over the top portion of the stoppers, and goes around to the back surfaces. Finally, the resin touches down on the top surface of the upper fitting arm or the top surface and/or the underside surface of the lower fitting arm.

During this process step, the expanding resin tends to be hooked at the top portion of each stopper. Therefore, pinholes may develop over an area ranging from this top portion to the top surface of the upper fitting arm or the top surface and/or the underside surface of the lower fitting arm.

Even if pinholes may have developed over an area ranging from the top portion of a stopper to the top surface of the corresponding upper fitting arm or the top surface and/or underside surface of the lower fitting arm, a transverse groove for air release is formed under the construction of claim 5 at a position closely behind the base of at least a stopper of either the upper or lower fitting arm so that the groove extends to both sides of at least one fitting arm across the top surface of the upper fitting arm or across the top surface and/or the underside surface of the lower fitting arm. By way of this groove, the pinholes are connected to the outside of the bottle. Therefore, with the neck kept sealed, any pinholes can be detected reliably by means of pressurized air.

In conformity with the shape of the recessed portion of the bottle, the upper fitting arm and the lower fitting arm have a different shape, and there is also a difference in the incidence of pinhole development between both fitting arms. Therefore, it is not necessary to form the transverse groove for each of the stoppers of both fitting arms. The groove can be formed only for one of the fitting arms, considering whichever arm is more vulnerable to any pinhole development.

The means of carrying out the invention of claim 6 comprises that, in the invention of claim 5, the handle has a cross-section of an H-beam structure in which two plates are connected by a central rib, with this structure ranging from the upper fitting arm to the lower fitting arm with the grip in between. The handle in this shape is constructed so that both ends of the transverse groove are connected to both depressed side portions of the upper or lower fitting arm derived from the H-beam structure.

The cross-section of the handle in the H-beam structure is effective for a light-weight handle or for material cost reduction. As a result of the H-beam structure for both the upper and lower fitting arms, the depressed side portions are formed on both sides of the upper fitting arm or the lower fitting arm. The above construction of claim 6 intends that these depressed side portions of the upper or lower fitting arm derived from the H-beam structure are utilized as the passages for air release. The pinhole inspections can be reliably conducted by extending a transverse groove for air release to both sides of the upper or lower fitting arm and connecting the groove to the depressed side portions.

The means of carrying out the invention of claim 7 comprises that, in the invention of claim 5 or 6, a transverse ridge is formed at a position closely behind the base of a stopper of either the upper fitting arm or the lower fitting arm so that the ridge extends to both sides of the fitting arm: (i) across a top surface of the upper fitting arm; (ii) across a top or underside surface of the lower fitting arm; (iii) across each of the top and underside surface of the lower fitting arm; (iv) across the top surface of the upper fitting arm, with another ridge across the top or underside surface of the lower fitting arm; or (v) across the top surface of the upper fitting arm, with two more ridges across the top and underside surface of the lower fitting arm and that a groove for air release is formed beside this ridge.

Under the above construction of claim 7, a transverse ridge is formed so that the ridge extends to both sides of a fitting arm across the top surface of the upper fitting arm or across the top surface and/or the underside surface of the lower fitting arm, and a transverse groove is notched beside the ridge. Because of this ridge, it becomes possible to prevent a decrease in strength of the upper and/or lower fitting arm(s) effectively.

Effects of the Invention

This invention having above-described construction has the following effects:

According to the invention of claim 1, the resin does not exactly trace the shape of the ridge or the groove because of the strain hardening effect involved in drawing and deformation, but there remains at least a space which can be used as a passage for air release. Even if pinholes may have developed over an area ranging from the top portion of a stopper to the top surface of the corresponding upper fitting arm or the top surface and/or the underside surface of the corresponding lower fitting arm, the passage(s) would perform an air release function, and thus, with the neck kept sealed, any pinholes can be detected reliably by means of pressurized air.

According to the invention of claim 2, even if pinholes may have developed over an area ranging from the top portion of a stopper to the top surface of the upper fitting arm or the top surface and/or the underside surface of the lower fitting arm, the passages formed along the ridge would perform an air release function, and thus, with the neck kept sealed, any pinholes can be detected reliably by means of pressurized air.

According to the invention of claim 3, the inverted trapezoidal shape having a larger lateral width at the top than at the base allows the ridge to have spaces securely between the resin and both sides of the ridge. These spaces serve reliably as the connecting passages for air release.

According to the invention of claim 4, even if pinholes may have developed in the area ranging from the top portion of a stopper to the top surface of the upper fitting arm or the top surface and/or the underside surface of the lower fitting arm, the passage running through the groove would perform the air release function as the pinholes are connected to outside air through the passage, and thus, with the neck kept sealed, any pinholes can be detected reliably by means of pressurized air.

According to the invention of claim 5, even if pinholes may have developed over an area ranging from the top portion of a stopper to the top surface of the corresponding upper fitting arm or the top surface and/or the underside surface of the corresponding lower fitting arm, a transverse groove for air release is formed at a position closely behind the base of a stopper of either the upper or lower fitting arm so that the groove extends to both sides of a fitting arm across the top surface of the upper fitting arm or across the top surface and/or the underside surface of the lower fitting arm. Through this groove, pinholes, if any, can be connected to outside air. Thus, with the neck kept sealed, any pinholes can be detected reliably by means of pressurized air.

According to the invention of claim 6, the pinhole inspections can be reliably conducted by extending a transverse groove for air release to both sides of the upper or lower fitting arm and connecting the transverse groove to the depressed side portions of both fitting arms derived from the H-beam structure.

According to the invention of claim 7, a transverse ridge is formed so that the ridge extends to both sides of a fitting arm across the top surface of the upper fitting arm or across the top surface and/or the underside surface of the lower fitting arm, and a transverse groove is notched beside the ridge. Because of this ridge, it becomes possible to prevent a decrease in strength of the upper and/or lower fitting arm(s) effectively.

BRIEF DESCRIPTION OF THE DRAWINGS

FIG. 5(*b*) is a vertical section of the ridge taken from line A-A in FIG. 5(*a*).

FIG. 6(*b*), showing the ridge in an inserted state.

FIG. 8(*b*) is an enlarged side view, of the handle in the embodiment shown in FIG. 7.

FIG. 11(*b*) is a vertical section of the groove taken from line B-B in FIG. 11(*a*).

FIG. 12(*b*), showing the groove in an inserted state.

FIG. 13(*b*) is an enlarged side view, and

FIG. 13(*c*) is an enlarged bottom view, of a lower portion of the handle shown in FIG. 8, including the nearby lower fitting arm.

DESCRIPTION OF REFERENCE SIGNS

Figure 1:
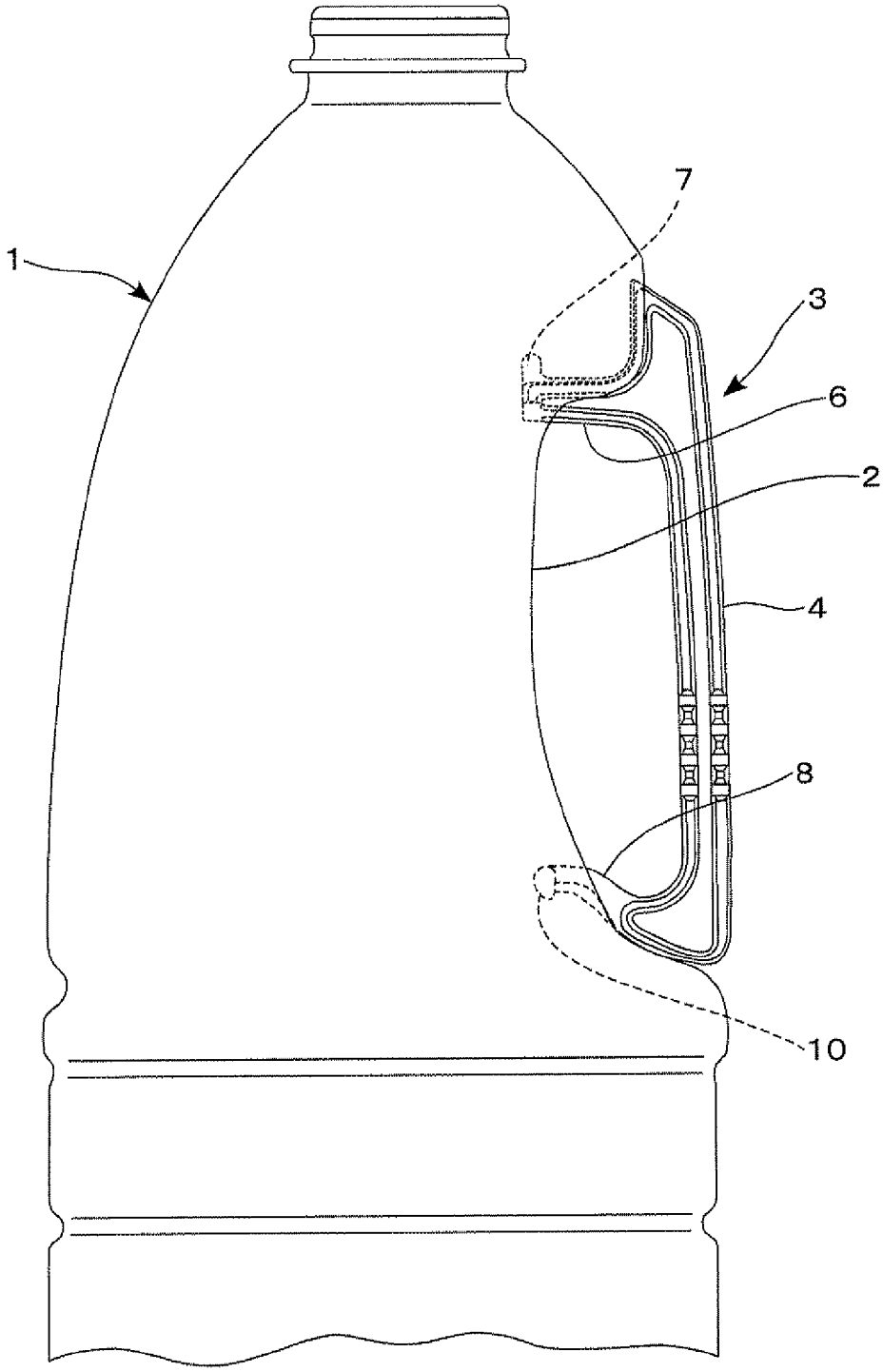
FIG. 1 is a side view of an upper portion of the bottle in the first embodiment of this invention.

1. Bottle
2. Recessed portion
3. Handle
4. Grip
5. Central rib
6. Upper fitting arm
6*t*. Top surface of the upper fitting arm
6*s*. Beam side
6*sd*. Depressed side portion
7. Stopper
7*t*. Top portion of the stopper
7*b*. Back surface of the stopper
8. Lower fitting arm
8*t*. Top surface of the lower fitting arm
8*u*. Underside surface of the lower fitting arm
9. Reinforcing rib
10. Stopper
10*t*. Upward projecting stopper
11. Ridge
11*t*. Ridge top surface
11*s*. Ridge side
12. Connecting passage

13 (13*t*, 13*u*). Groove
13*s*. Groove sidewall
13*b*. Groove bottom
15. Transverse groove
16. Transverse ridge
R. Resin
PH. Pinhole
S. Space

Preferred Embodiments

Figure 2:
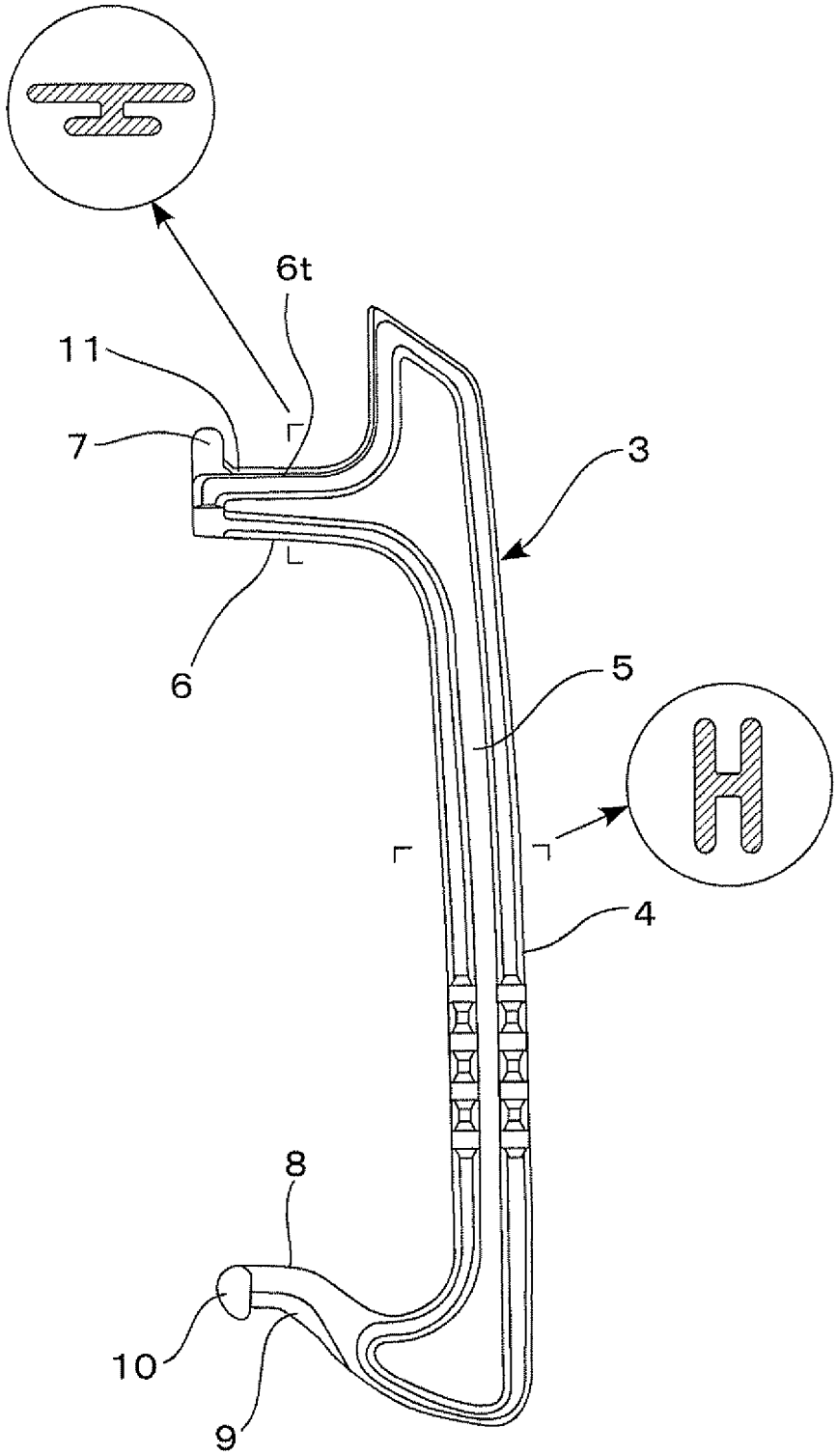
FIG. 2 is a side view of the handle in the embodiment shown in FIG. 1.
Figure 3:
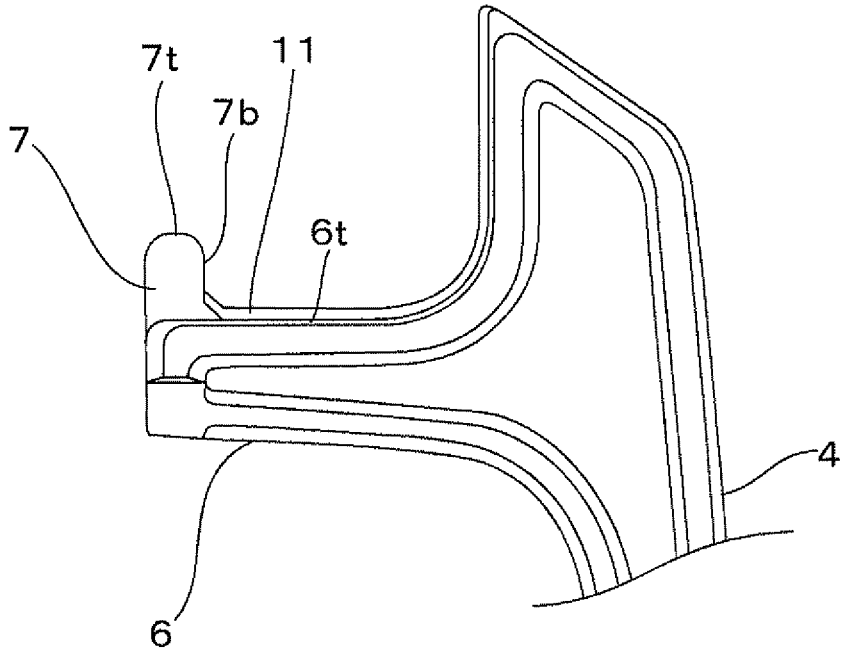
FIG. 3 is an enlarged side view of an upper portion of the handle shown in FIG. 2, including the nearby upper fitting arm.
Figure 4:
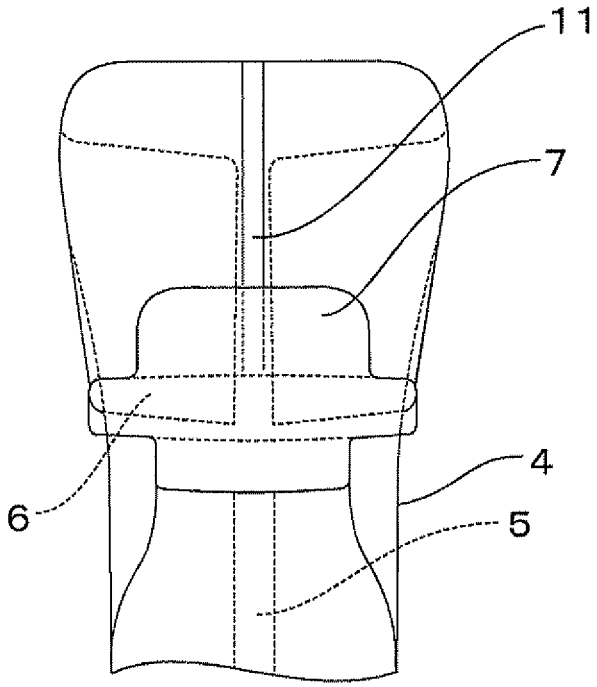
FIG. 4 is an enlarged front view of an upper portion of the handle shown in FIG. 2, including the nearby upper fitting arm.
Figure 5:
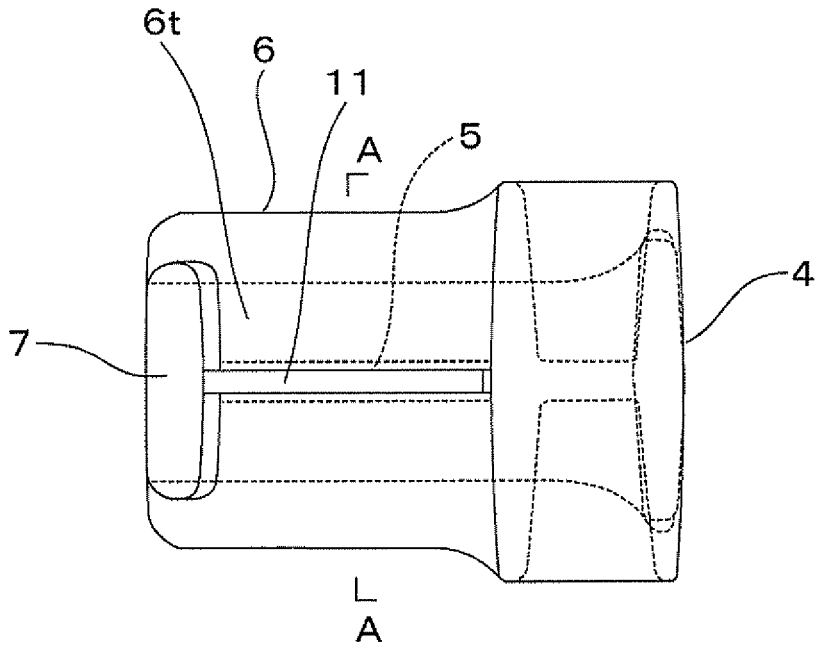
FIG. 5(*a*) is an enlarged plan view of an upper portion of the handle shown in FIG. 2, including the nearby upper fitting arm.
Figure 5:
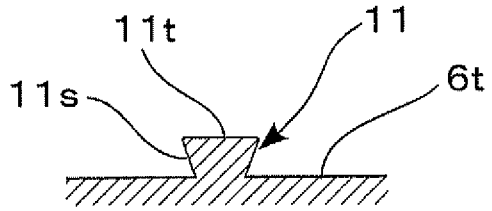

This invention is further described with respect to preferred embodiments, now referring to the drawings. FIGS. 1 to 5 show the synthetic resin bottle with a handle in the first embodiment of this invention. Among them, FIG. 1 is a side view of an upper portion of the bottle. FIG. 2 is a side view of the handle 3 used in the bottle of FIG. 1. FIGS. 3, 4, and 5(*a*) are an enlarged side, front, and plan views, respectively, of an upper portion of the handle 3 including the nearby upper fitting arm 6.

The bottle of the first embodiment has a capacity of 1.8 liters, and comprises a bottle 1, which is a biaxially drawn, blow molded product made of a polyethylene terephthalate resin; and a handle 3, which is an injection molded product made of the same polyethylene terephthalate resin and which is fitted to a recessed portion 2 disposed at the rear of the body of the bottle 1 by an insert molding process.

The handle 3 comprises an upper fitting arm 6 and a lower fitting arm 8 disposed at an upper end and a lower end, respectively, of a grip 4 so that both arms extend forward from the grip. The handle 3 has a cross-section of an H-beam structure in which two plates are connected integrally by a central rib 5, and this structure ranges from the grip 4 to both the upper fitting arm 6 and the lower fitting arm 8 (See a cross-section attached to FIG. 2).

A stopper 7 is disposed at the forefront of the upper fitting arm 6. This stopper projects upward to a height of 4.5 mm, with top surface 6*t* of the upper fitting arm 6 serving as the base for the stopper 7. At the time of blow molding, large force acts on the stopper 7 in the rearward direction. Thus, for the purpose of reinforcement, the stopper 7 has a tapered lower portion at the back surface 7*b*.

A ridge 11 is formed so that it extends rearward from the tapered lower portion of the back surface 7*b* of the stopper 7 along a center line of the top surface 6*t* of the upper fitting arm 6. As shown in FIG. 5(*b*), this ridge 11 has an inverted trapezoidal shape having a larger lateral width at the top than at the base. The ridge 11 passes by the base of the upper fitting arm 6, climbs up the vertical wall, and ends up at the crest of the grip 4.

The lower fitting arm 8 projects obliquely upward in a curve, and gets gradually thinner as it comes close to the front. A reinforcing rib 9 is disposed in the front-back direction in a central part of the underside surface thereof along a front half of arm length to prevent deformation of the arm 8. A stopper 10 is integrally disposed at the forefront of the lower fitting arm 8 in a manner that the lower end of the stopper 10 is at a level lower than the underside of the reinforcing rib 9.

A synthetic resin bottle with a handle can be obtained by using this handle 3 as an insert and biaxially drawing and blow molding the bottle. As shown in FIG. 1, the stopper 7 of the upper fitting arm 6 and the stopper 10 of the lower fitting arm 8 are fitted firmly in the undercut engagement, respectively, to the upper and lower ends of the recessed portion 2 of this bottle 1.

Figure 6:
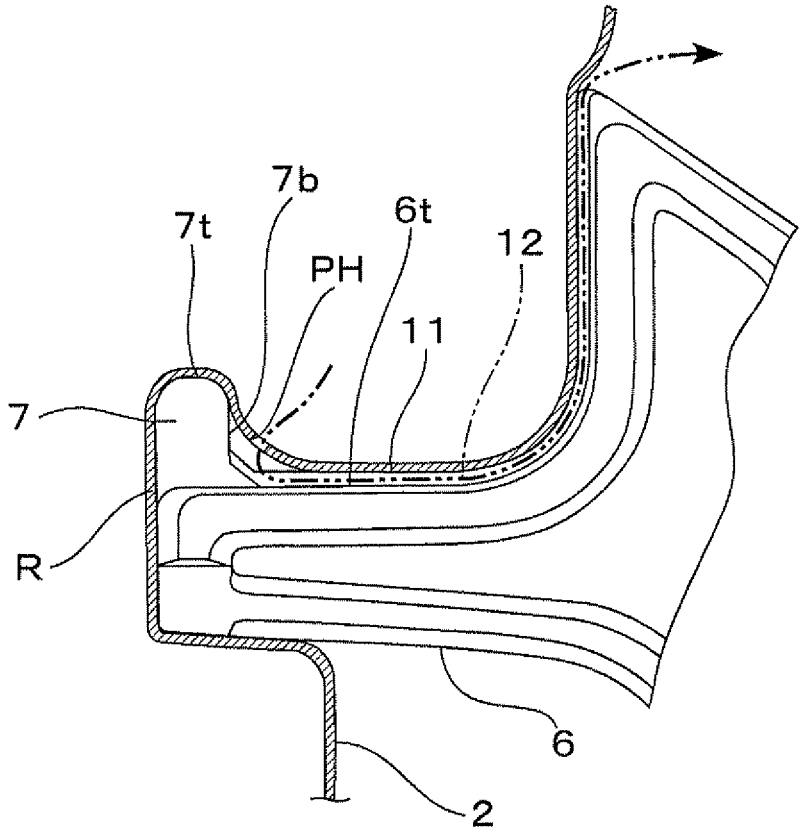
FIG. 6(*a*) is an explanatory diagram showing the upper fitting arm in an inserted state.
Figure 6:
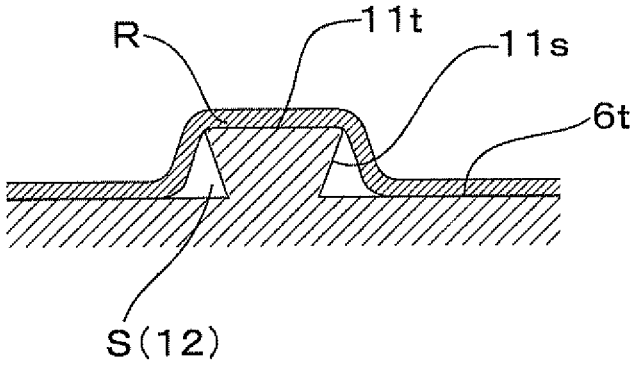

FIG. 6(*a*) is an explanatory diagram showing the upper fitting arm 6 in its inserted state and the resin R that goes around the stopper 7 and touches down on the upper fitting arm 6.

In the biaxial drawing and blow molding process using the handle 3 as an insert, the resin R is drawn in the longitudinal direction and is deformed in the circumferential direction. At that time, the resin R bumps into the forefront of the stopper 7, then climbs over the top portion 7*t* of the stopper 7 having a projecting height of 4.5 mm, and goes around to the back surface 7*b*. From there, the resin R goes over the base of the stopper 7 on the rear side without any direct contact, and touches down on the top surface 6*t* of the upper fitting arm 6 (See FIG. 6(*a*)).

Since the ridge 11 is formed on the upper fitting arm 6, the resin R first touches the ridge top surface 11*t* of the ridge 11 before the resin touches down on the top surface 6*t* of the arm 6. Then, the resin R goes around the ridge 11 toward both ridge sides 11*s*, and comes in tight contact with the top surface a of the upper fitting arm 6. This ridge 11 has a cross-section in an inverted trapezoidal shape, and therefore, the expanding resin R goes around to the ridge base but not in tight contact with both ridge sides. Thus, spaces S are formed between the resin R and both ridge sides 11*s*, as shown in FIG. 6(*b*). These spaces S running along the ridge 11 are utilized as connecting passages 12.

During this drawing and deforming step, the expanding resin R tends to be hooked at the top portion 7*t* of the stopper 7. Therefore, pinholes may sometimes develop over an area ranging from this top portion 7*t* to the top surface 6*t* of the upper fitting arm 6. But since the inside of the bottle 1 is connected to outside through these connecting passages 12 (See the chain double-dashed line in FIG. 6(*a*)), any pinholes can be detected reliably by means of pressurized air applied while the neck is kept sealed.

When the bottle is blow molded, the resin R is expanded and deformed to a great extent along the top surface of the upper fitting arm 6 in the rearward direction. However, since the ridge 11 is formed in the direction of drawing progress, the resin R is smoothly drawn without being distracted by the ridge 11.

The fitting arm strength can be improved by forming the ridge 11. When the bottle is blow molded, spaces are formed between the expanding resin R and both ridge sides 11*s*, as described above. However, the expanding resin R goes around the ridge 11 toward the ridge sides 11*s* after the resin has touched down on the ridge top surface 11*t* (See FIG. 6(*b*)). Thus, the ridge 11 performs a locking function to prevent the bottle effectively from rattling in the lateral direction.

Figure 7:
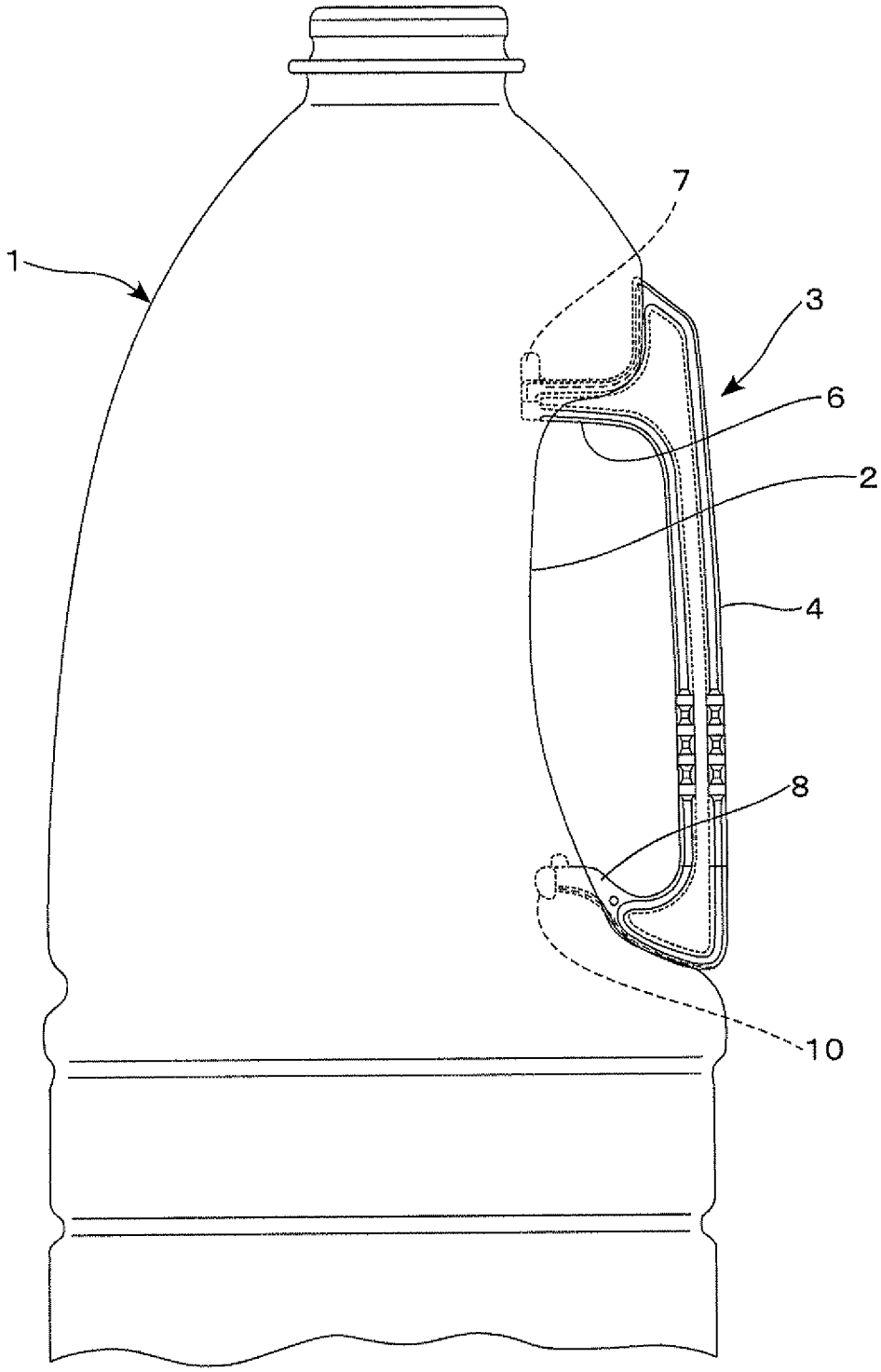
FIG. 7 is a side view of an upper portion of the bottle in the second embodiment of this invention.
Figure 8:
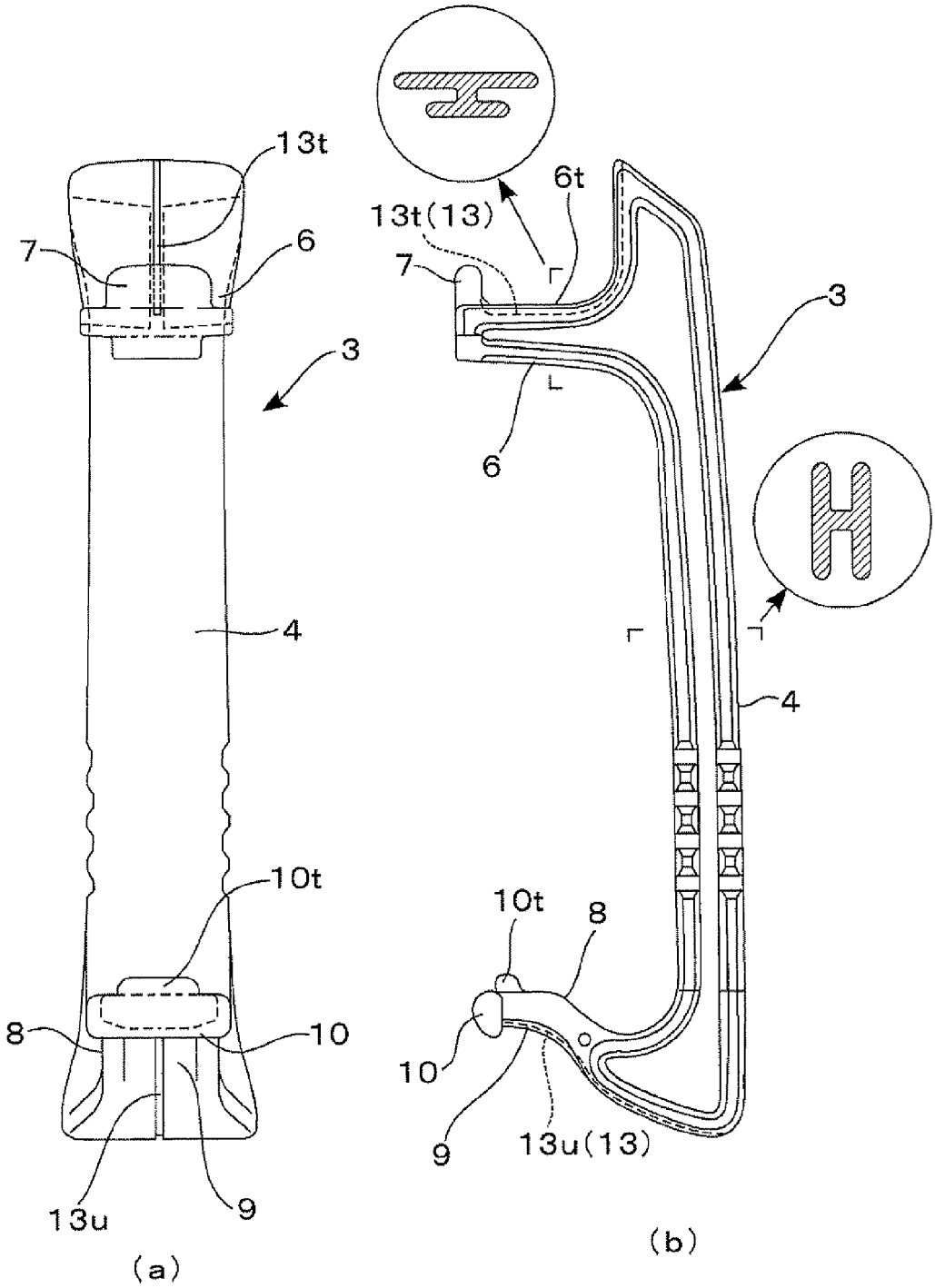
FIG. 8(*a*) is an enlarged front view.
Figure 9:
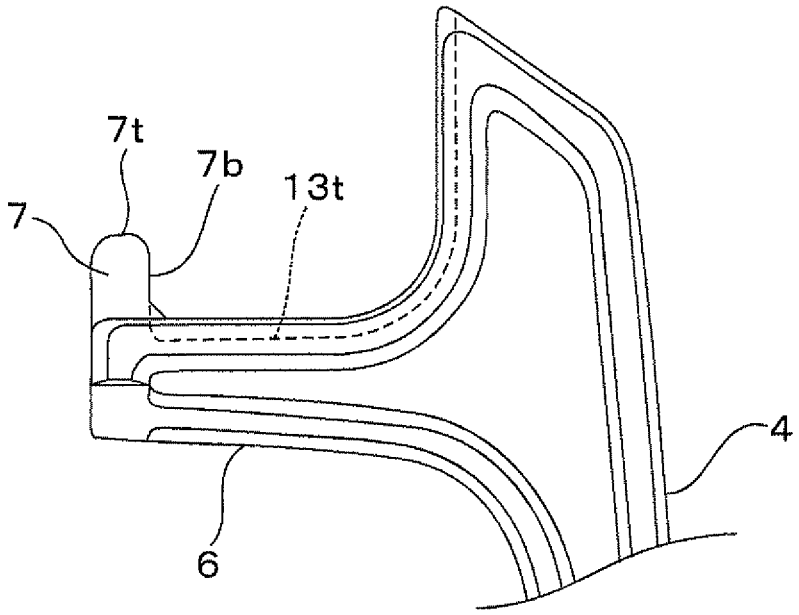
FIG. 9 is an enlarged side view of an upper portion of the handle shown in FIG. 8, including the nearby upper fitting arm.
Figure 10:
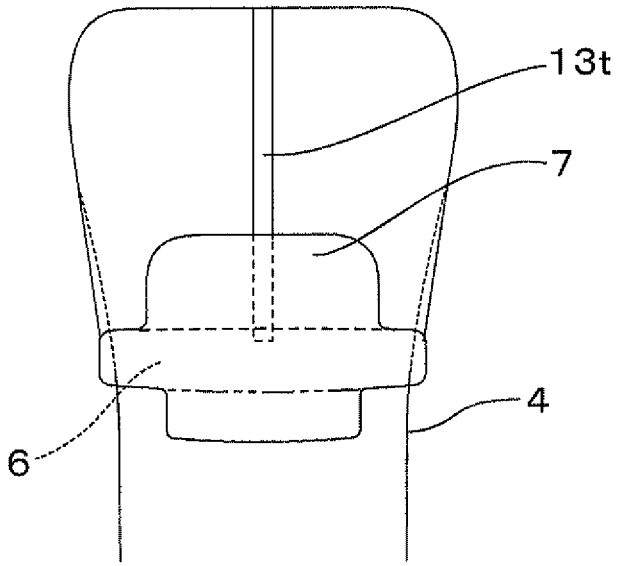
FIG. 10 is an enlarged front view of an upper portion of the handle shown in FIG. 8, including the nearby upper fitting arm.
Figure 11:
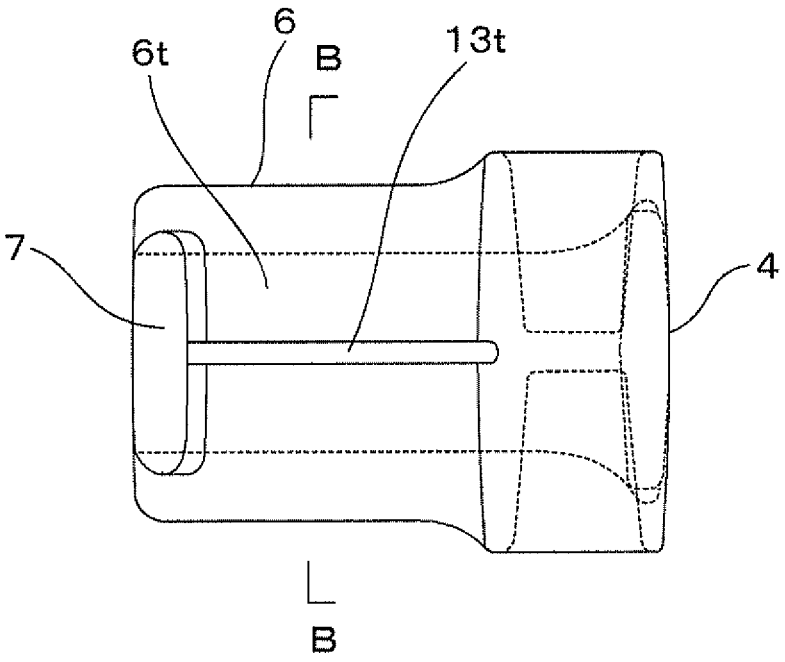
FIG. 11(*a*) is an enlarged plan view of an upper portion of the handle shown in FIG. 8, including the nearby upper fitting arm.
Figure 11:
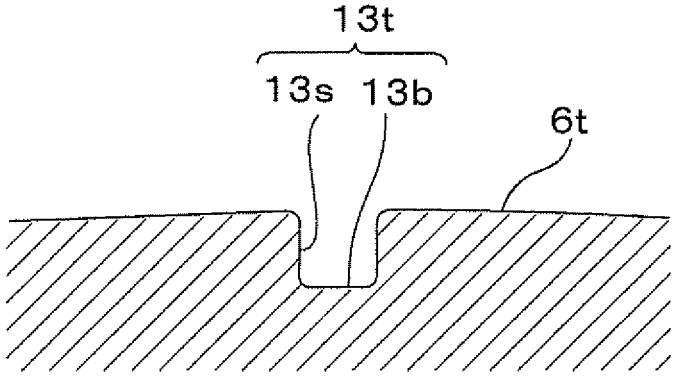
Figure 13:
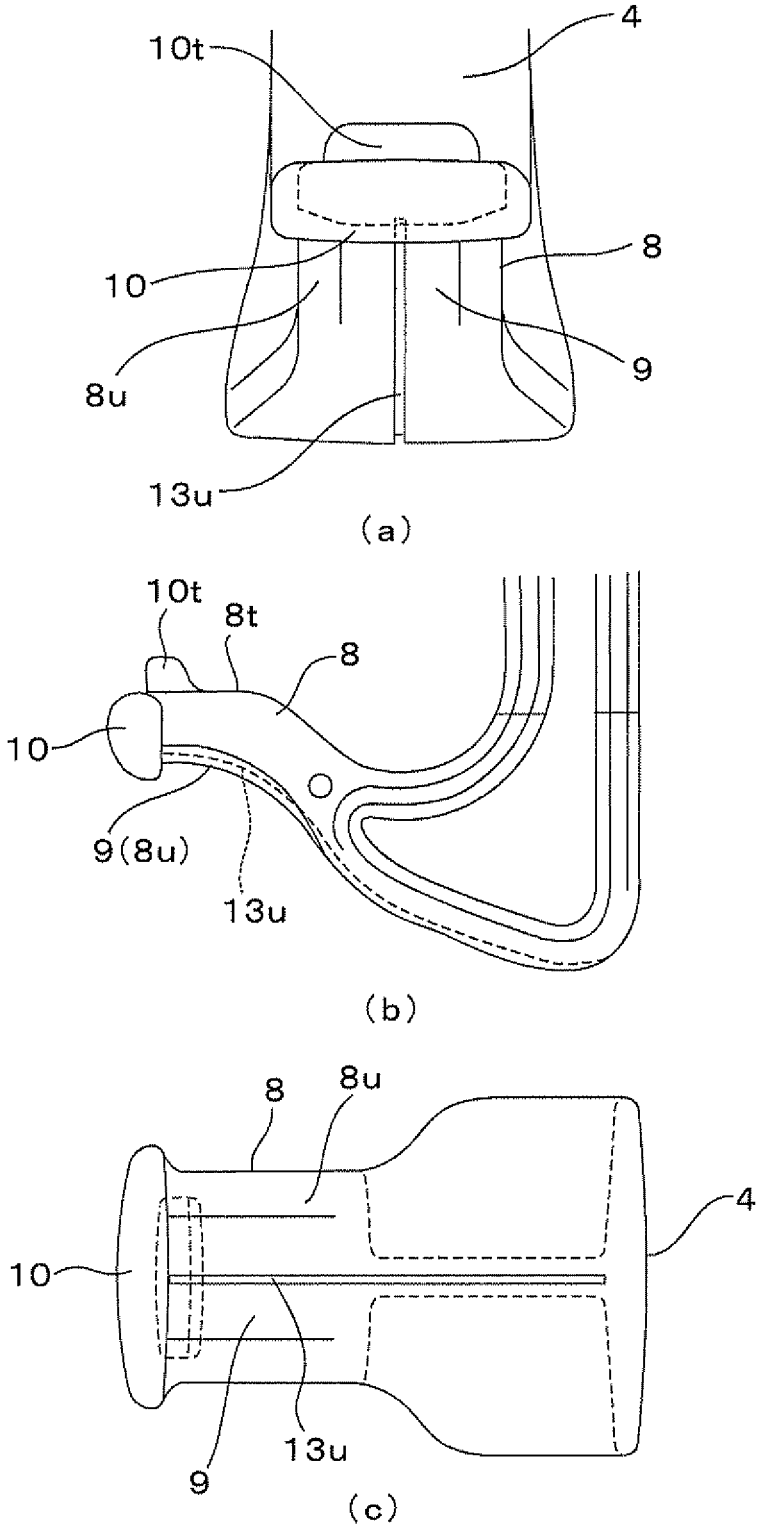
FIG. 13(*a*) is an enlarged front view.

FIGS. 1 to 5 show the synthetic resin bottle with a handle in the second embodiment of this invention. Among them, FIG. 7 is a side view of an upper portion of the bottle with a handle. FIG. 8(*a*) is an entire front view, and FIG. 8(*b*) is an entire side view, of the handle 3. FIGS. 9, 10, and 11(*a*) are enlarged side, front, and plan views of a part of the handle near the upper fitting arm 6. FIG. 11(*b*) is a vertical section of a groove 13*t* taken from line B-B in FIG. 11(*a*). FIGS. 13(*a*), 13(*b*), and 13(*c*) are enlarged front, side, and bottom views, respectively, of a part of the handle 3 near the lower fitting arm 8.

As in the first embodiment, the bottle of the second embodiment comprises a bottle 1, which is a biaxially drawn, blow molded product made of a polyethylene terephthalate resin; and a handle 3, which is an injection molded product made of the same polyethylene terephthalate resin and which is fitted to a recessed portion 2 at the rear of the body of the bottle 1 by an insert molding process. The bottle 1 has a capacity of 1.8 liters. The handle 3 of this embodiment comprises a groove 13, instead of the ridge 11 used in the handle 3 of the first embodiment. This groove 13 is formed in the top surface 6*t* of the upper fitting arm 6 and/or in the underside surface 8*u* of the lower fitting arm 8, and is used for air release.

The handle 3 comprises the upper fitting arm 6 and the lower fitting arm 8 disposed at an upper end and a lower end, respectively, of the grip 4 so that both arms extend forward from the grip. The handle 3 has a cross-section of an H-beam structure in which two plates are connected integrally by a central rib 5, and this structure ranges from the grip 4 to both the upper fitting arm 6 and the lower fitting arm 8 (See a cross-section attached to FIG. 8(*b*)).

A stopper 7 is disposed at the forefront of the upper fitting arm 6. This stopper projects upward to a height of 4.5 mm, with the top surface 6*t* of the upper fitting arm 6 serving as the base for the stopper 7. At the time of blow molding, large force acts on the stopper 7 in the rearward direction. Thus, for the purpose of reinforcement, the stopper 7 has a tapered lower portion at the back surface 7*b*.

The groove 13*t* is formed so that it extends rearward from the tapered lower portion of the back surface 7*b* of the stopper 7 along the center line of the top surface 6*t* of the upper fitting arm 6. As shown in FIG. 11(*b*), this groove 13*t* has a rectangular shape in general, and it passes by the base of the upper fitting arm 6, climbs up the vertical wall, and ends up at the crest of the grip 4.

The lower fitting arm 8 projects obliquely upward in a curve. A reinforcing rib 9 is disposed in a central area of the underside thereof along a front half of the arm length to prevent deformation of the arm 8. A stopper 10 is integrally disposed at the forefront of the lower fitting arm 8 in a manner that the lower end of the stopper 10 is at a level lower than the underside of the reinforcing rib 9. Furthermore, the lower fitting arm 8 is also provided with a stopper 10*t* projecting upward from a top surface 8*t*.

Another groove 13*u* is formed so as to extend rearward from a laterally central position just behind the base of the stopper 10 (that is, the position of the reinforcing rib 9 which is laterally central in this embodiment) to the lowest point of the handle 3 along the longitudinal center line of the underside surface 8*u* of the lower fitting arm 8. On the way, the groove 13*u* passes by the base of the lower fitting arm 8 and ends up at the lower end of the grip 4. The groove 13*u* has a cross-sectional shape similar to that of the groove 13*t* (See FIG. 11(*b*)).

A synthetic resin bottle with a handle can be obtained by using this handle 3 as an insert and biaxially drawing and blow molding the bottle. As shown in FIG. 7, the stopper 7 of the upper fitting arm 6 and the stoppers 10 and 10*t* of the lower fitting arm 8 are fitted firmly in the undercut engagement, respectively, to the upper and lower ends of the recessed portion 2 of the bottle 1.

Figure 12:
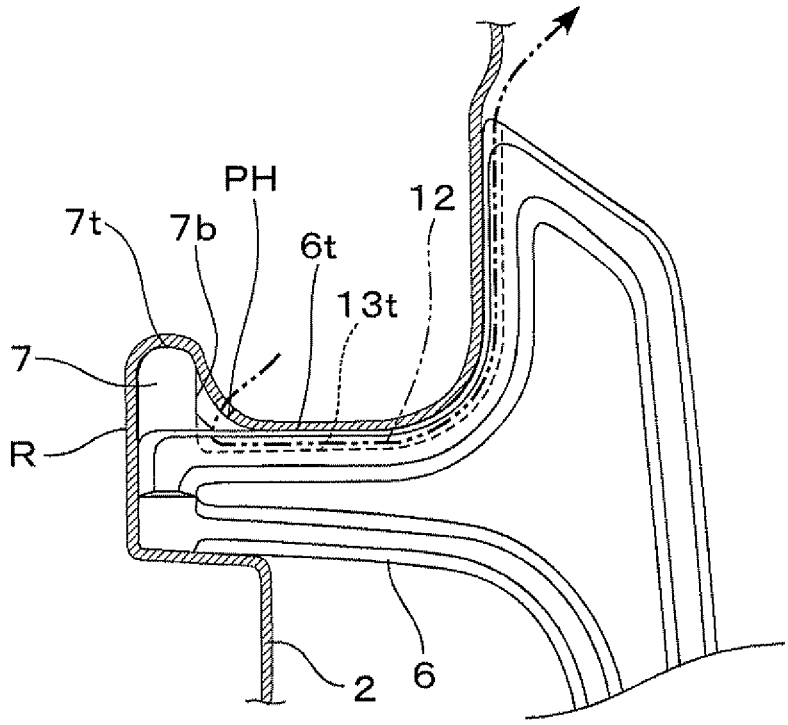
FIG. 12(*a*) is an explanatory diagram showing the upper fitting arm in an inserted state.
Figure 12:
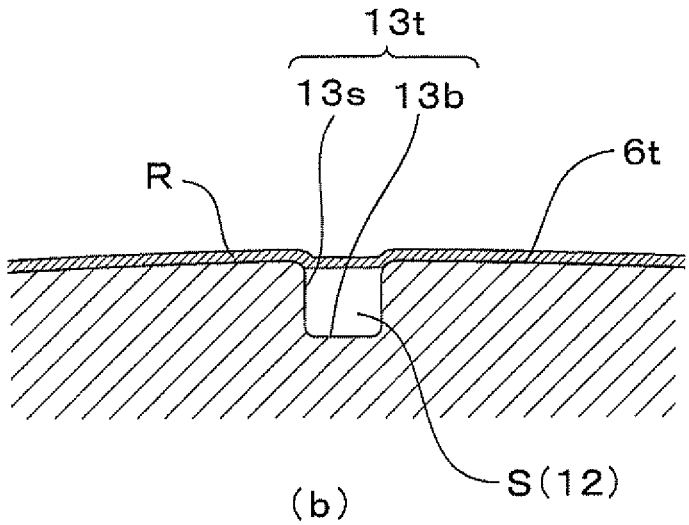

FIG. 12(*a*) is an explanatory diagram showing an area near the upper fitting arm 6 in its inserted state and the resin R that goes around the stopper 7 and touches down on the upper fitting arm 6.

In the biaxial drawing and blow molding process using the handle 3 as an insert, the resin R is drawn in the longitudinal direction and is deformed in the circumferential direction. During this drawing and deformation, the resin R bump into the forefront of the stopper 7, then climbs over the top portion of the stopper 7 having a projecting height of 4.5 mm, and goes around to the back surface 7*b*. From here the resin R goes over the portion behind the stopper 7 without any direct contact, and touches down on the top surface 6*t* of the upper fitting arm 6 (See FIG. 12(*a*)).

Since the groove 13*t* is formed in the top surface 6*t* of the upper fitting arm 6, the resin R in a strain hardening effect involved in drawing and deformation first touches down on the top surface 6*t* of the arm 6 simply to cover the surface and the groove opening without deforming the groove 13*t*. Thus, the space S is formed between the resin R on one hand and the bottom wall 13*b* and the side walls 13*s* of the groove on the other hand, as shown in FIG. 12(*b*). This space S running through the groove 13*t* is utilized as a connecting passage 12 for air release.

During this drawing and deforming step, the expanding resin R tends to be hooked at the top portion 7*t* of the stopper 7. Therefore, pinholes may sometimes develop over an area ranging from this top portion 7*t* to the top surface 6*t* of the upper fitting arm 6, as shown in FIG. 12(*a*). But the inside of the bottle 1 is connected to outside through the connecting passage 12 (See the chain double-dashed line in FIG. 12(*a*)). With the neck kept sealed, any pinholes can be detected reliably by means of pressurized air.

As described above, the groove 13*u* is also formed in this embodiment in the underside surface 8*u* of the lower fitting arm 8. Even if pinholes happen to develop as caused by the stopper 10 having the lower end projecting downward, any pinholes can be detected reliably by means of pressurized air. Although in this embodiment, no groove or ridge for air release is formed in/on the top surface 8*t* of the lower fitting arm 8, it may be formed, if necessary, in case of pinhole development caused by the stopper lot which projects upward.

When the bottle is blow molded, the resin R is expanded and deformed to a great extent along the top surface 6*t* of the upper fitting arm 6 or along the underside surface 8*u* of the lower fitting arm 8 in the rearward direction from the forefront of each arm. However, since the groove 13 is formed in the direction of drawing progress, the resin R is smoothly drawn without being distracted by any groove 13.

Figure 14:
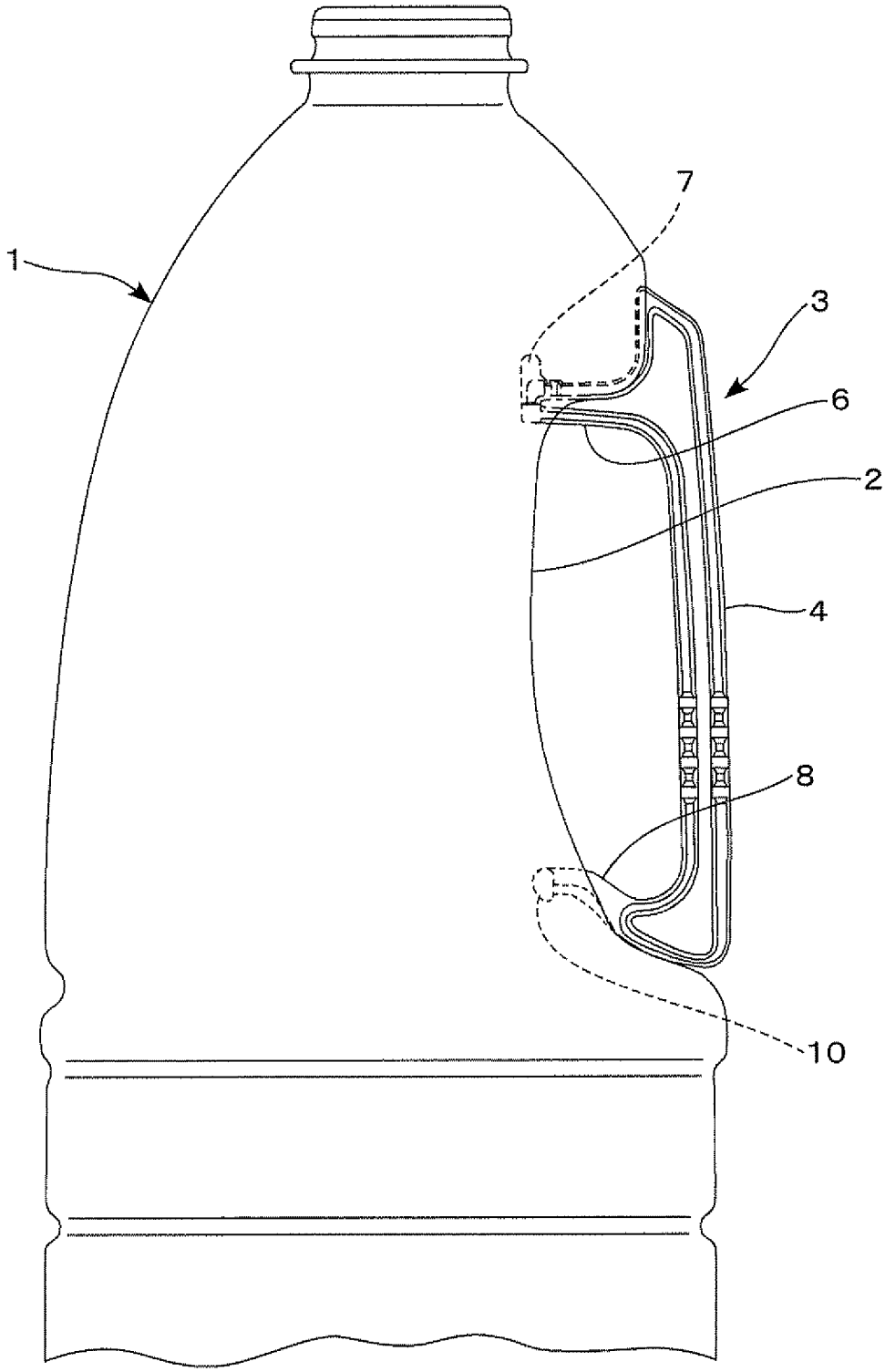
FIG. 14 is a side view of an upper portion of the bottle in the third embodiment of this invention.
Figure 15:
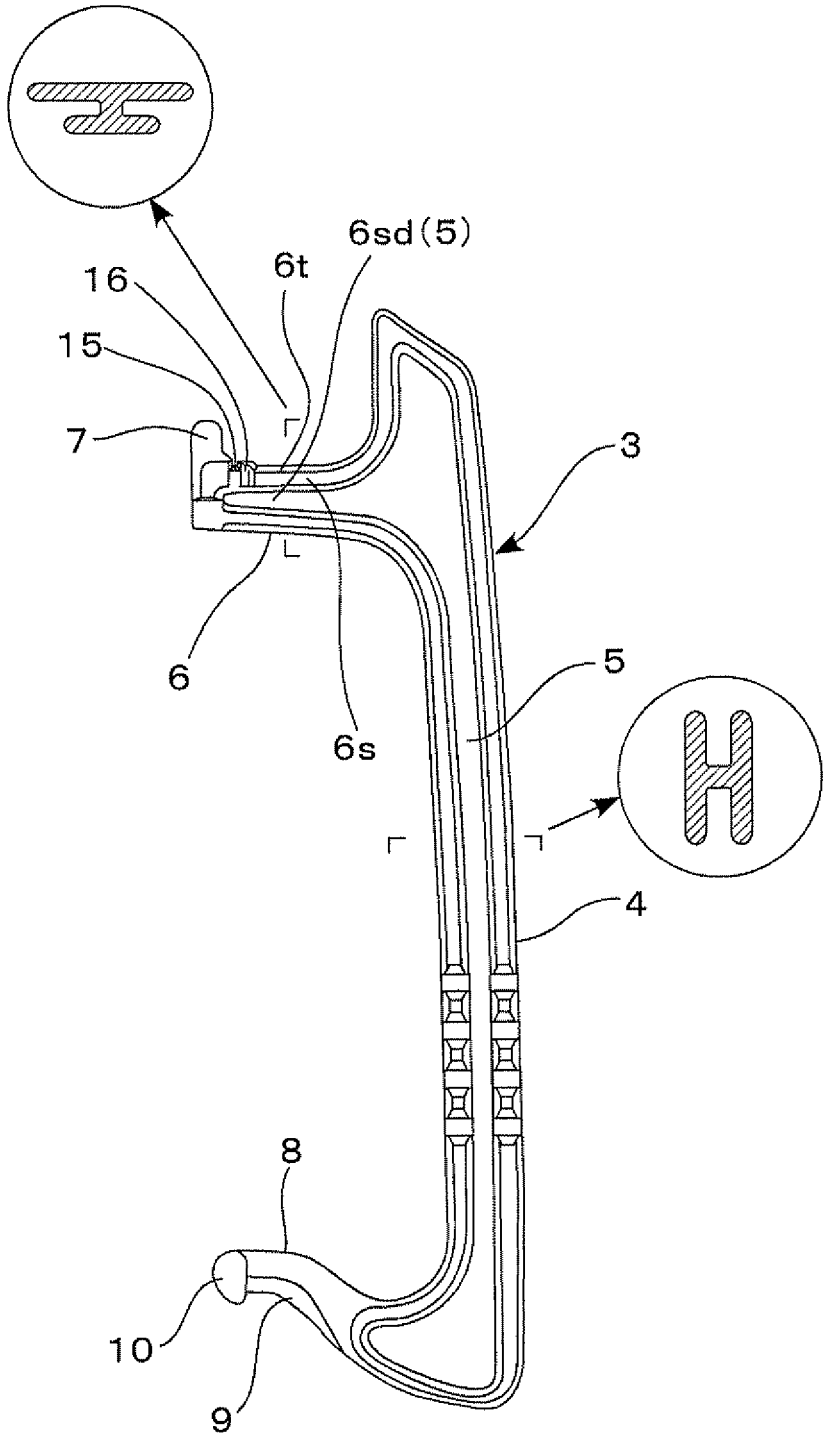
FIG. 15 is a side view of the handle in the embodiment shown in FIG. 14.
Figure 16:
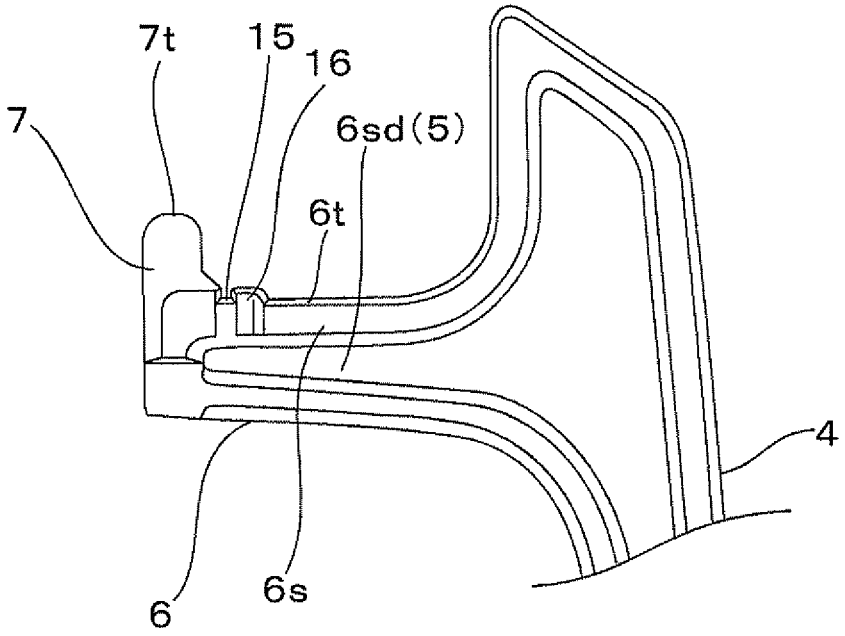
FIG. 16 is an enlarged side view of an upper portion of the handle shown in FIG. 15, including the nearby upper fitting arm.
Figure 17:
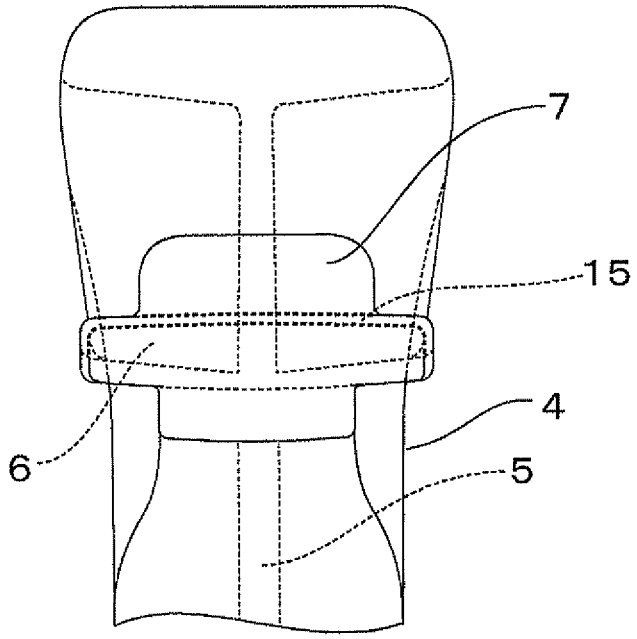
FIG. 17 is an enlarged front view of an upper portion of the handle shown in FIG. 15, including the nearby upper fitting arm.
Figure 18:
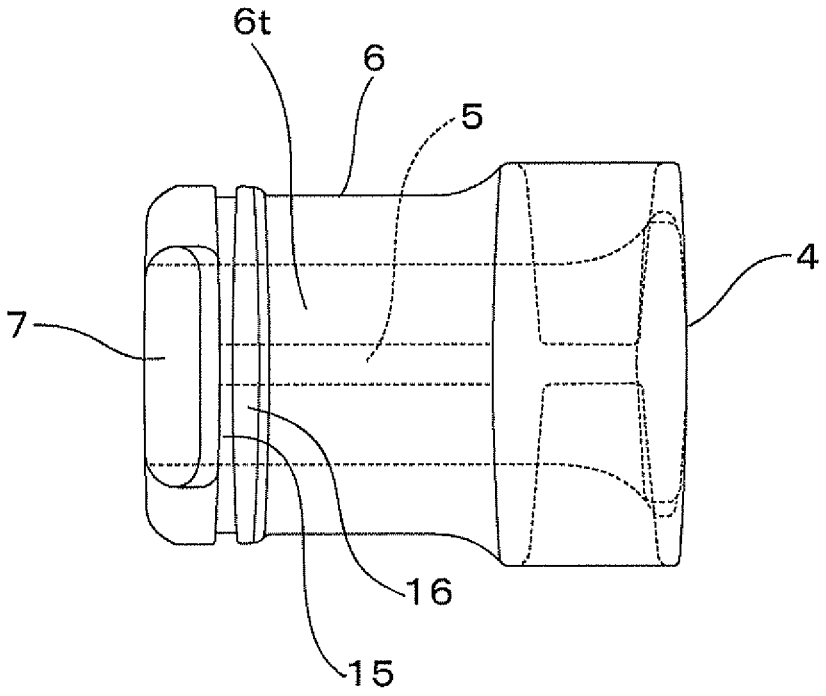
FIG. 18 is an enlarged plan view of an upper portion of the handle shown in FIG. 15, including the nearby upper fitting arm.

FIGS. 14-18 show the synthetic resin bottle with a handle in the third embodiment of this invention. Among them, FIG. 14 is a side view of an upper portion of the bottle; FIG. 15, a side view of the handle used in the bottle of FIG. 14; FIGS. 16, 17, and 18, an enlarged side, front, and plan view, respectively, of an upper portion of the handle including the nearby upper fitting arm 6.

The bottle of the third embodiment has a capacity of 1.8 liters and comprises a bottle 1, which is a biaxially drawn, blow molded product made of a polyethylene terephthalate resin; and a handle 3, which is an injection molded product made of the same polyethylene terephthalate resin and which is fitted to the recessed portion 2 disposed at the rear of the body of the bottle 1 by an insert molding process.

The handle 3 comprises an upper fitting arm 6 and a lower fitting arm 8 disposed at an upper end and a lower end, respectively, of a grip 4 so that both arms extend forward from the grip 4. The handle 3 has a cross-section of an H-beam structure in which two plates are connected integrally by a central rib 5, and this structure ranges from the grip 4 to both the upper fitting arm 6 and the lower fitting arm 8 (See a cross-section attached to FIG. 15).

A stopper 7 is disposed at the forefront of the upper fitting arm 6. This stopper 7 projects upward to a height of 4.5 mm from the top surface 6*t* of the upper fitting arm 6 that serves as the base for the stopper 7. A transverse ridge 16 is formed at a position closely behind the base of the stopper 7 of the upper fitting arm 6 so that this ridge 16 extends laterally to both beam sides 6*s* of the upper fitting arm 6 across the top surface 6*t*. A groove 15 for air release is formed beside this transverse ridge 16. Both ends of this groove 15 are at positions on both beam sides 6*s* where the groove 15 is connected to the depressed side portions 6*sd* derived from the H-beam structure.

The lower fitting arm 8 projects obliquely upward in a curve, and gets gradually thinner as it comes close to the front portion. A reinforcing rib 9 is disposed in the front-back direction in a central part of the underside surface thereof along a front half of the arm length to prevent deformation of the arm 8. A stopper 10 is integrally disposed at the forefront of the lower fitting arm 8 in a manner that the lower end of the stopper 10 is at a level lower than the underside of the reinforcing rib 9.

A synthetic resin bottle with a handle can be obtained by using this handle 3 as an insert and biaxially drawing and blow molding the bottle. As shown in FIG. 14, the stopper 7 of the upper fitting arm 6 and the stopper 10 of the lower fitting arm 8 are fitted firmly in the undercut engagement, respectively, to the upper and lower ends of the recessed portion 2 of this bottle 1.

Figure 19:
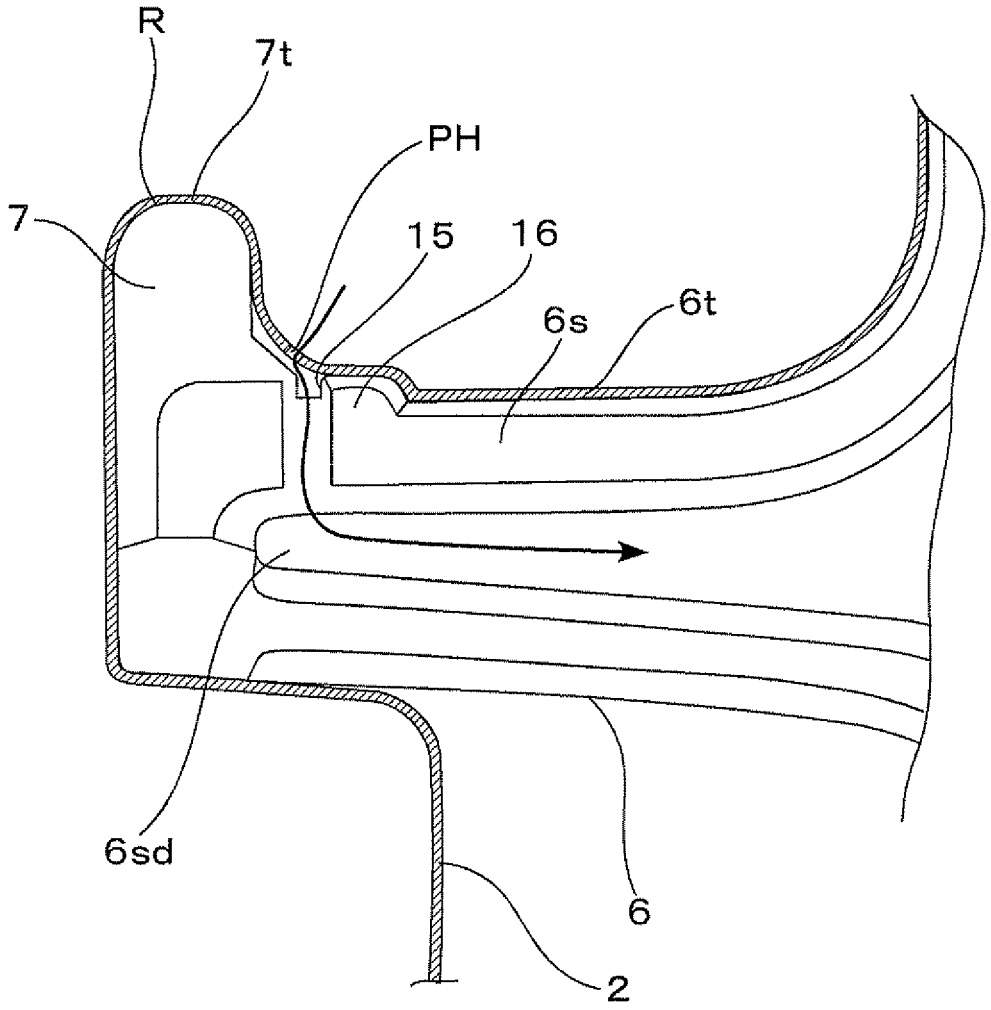
FIG. 19 is an explanatory diagram showing the forefront of the upper fitting arm in an inserted state.

FIG. 19 is an enlarged vertical-sectional side view of an area near the upper fitting arm 6, and is also an explanatory diagram showing the upper fitting arm 6 in its inserted state and the resin R that goes around the stopper 7 and touches down on the upper fitting arm 6.

In the biaxial drawing and blow molding process using the handle 3 as an insert, the resin R is drawn in the longitudinal direction and is deformed in the circumferential direction. At that time, the resin R bumps into the forefront of the stopper 7, then climbs over the top portion of the stopper 7 having a projecting height of 4.5 mm, and goes around to the back surface 7*b*. From here the resin R goes over the base of the stopper 7 without any direct contact, and touches down on the top surface 6*t* of the upper fitting arm 6. During this drawing and deforming step, the expanding resin R tends to be hooked at the top portion 7*t* of the stopper 7. Therefore, pinholes may sometimes develop over an area ranging from this top portion 7*t* to the top surface 6*t* of the upper fitting arm 6.

However, even if there is any pinhole PH in an area ranging from the top portion 7*t* of the stopper 7 to the top surface 6*t* of the upper fitting arm 6, the pinhole PH can be detected reliably by means of pressurized air applied with the neck being kept sealed, because the inside of the bottle 1 is connected to outside air by way of the groove 15 for air release and the depressed side portions 6*sd* (See the arrow in FIG. 19).

This invention has been described with respect to the preferred embodiments. However, it is to be understood here that this invention should not be construed as limitative to these embodiments. As a means of air release, for instance, the first embodiment provided an example of the ridge 11 formed on the upper fitting arm 6. The second embodiment provided an example of the grooves 13 formed in both of the upper fitting arm 6 and the lower fitting arm 8. However, various other embodiments can be selected so that either or both of the ridge 11 and/or the groove 13 may be formed for either or both of the upper fitting arm 6 and/or the lower fitting arm 8, taking into consideration a tendency of each arm toward the pinhole development, the necessity of reinforcement to increase the strength of each arm, a rattle-preventing effect, the injection molding and insert molding properties of the handle.

Also in the case of the first embodiment, the ridge 11 is designed to extend from the base of the stopper 7 up to the crest of the grip 4 by way of the top surface 6*t* and the base of the upper fitting arm 6. However, the length of the ridge 11 and the groove 13 can be set within a range in which the ridge or groove would fully perform the air release function, while giving consideration to the extent to which the bottle 1 comes in contact with the handle in the insert molding process.

The ridge 11 of the first embodiment has a cross-section in an inverted trapezoidal shape to ensure that the spaces S are easily formed. However, even if the cross-section of the ridge 11 is in a square shape, the spaces S can be formed because of the strain hardening effect caused by drawing and deformation when the resin goes around to both sides of the ridge 11.

In the case of the third embodiment, the transverse groove 15 is formed just behind the base of the stopper 7 of the upper fitting arm 6. However, if the tendency of each arm to develop pinholes is taken into consideration, the transverse groove for air release may also be formed behind the base of the stopper 10 of the lower fitting arm 8 or behind the bases of both stoppers 7 and 10.

INDUSTRIAL APPLICABILITY

As described above, the synthetic resin bottle with a handle of this invention enables pinholes to be detected reliably if the pinholes happen to develop in the vicinity of the handle fitted to the bottle in the undercut engagement. Since the bottle improves the precision of inspection step, there is great expectation for wide applications of use as a large-size bottle.

The invention claimed is:

1. A synthetic resin bottle with a handle, which are both biaxially drawn, blow molded products, the synthetic resin bottle comprising:

a body having a recessed portion disposed at a rear of the body thereof, wherein the handle is fitted in an undercut engagement to the recessed portion by an insert molding process, said handle comprising:

a grip in a vertically long plate shape, an upper fitting arm and a lower fitting arm disposed at an upper end and a lower end, respectively, of the grip so that both arms extend forward from the grip, a stopper extending upward from a front end of the upper fitting arm, and a stopper extending upward and/or downward from a front end of the lower fitting arm, wherein a ridge or a groove is formed so that it extends rearward from behind a base of at least the stopper of either the upper fitting arm or the lower fitting arm: (i) along a top surface of the upper fitting arm to a crest of the grip; (ii) along a top surface of the lower fitting arm to the grip or an underside surface of the lower fitting arm to a lower end of the grip; (iii) along the top surface of the lower fitting arm to the grip and the underside surface of the lower fitting arm to the lower end of the grip; (iv) along the top surface of the upper fitting arm to the crest of the grip, with another ridge or groove along the top surface of the lower fitting arm to the grip or the underside surface of the lower fitting arm to the lower end of the grip; or (v) along the top surface of the upper fitting arm to the crest of the grip, with two more ridges or grooves, one of the two along the top surface of the lower fitting arm to the grip and the other of the two along the underside surface of the lower fitting arm to the lower end of the grip, and wherein a connecting passage or passages for air release is/are formed to connect to outside of the bottle so that pinholes, if any, can be detected, said passage or passages being disposed along sides of this ridge or ridges and/or through this groove or grooves, by utilizing a space or spaces formed between a body wall and the sides of this ridge or ridges and/or this groove or grooves.

2. The synthetic resin bottle with a handle according to claim 1 wherein the ridge is formed so that it extends rearward from behind the base of at least the stopper of either the upper fitting arm or the lower fitting arm: (i) along the top surface of the upper fitting arm to the crest of the grip; (ii) along the top surface of the lower fitting arm to the grip or the underside surface of the lower fitting arm to the lower end of the grip; (iii) along the top surface of the lower fitting arm to the grip and the underside surface of the lower fitting arm to the lower end of the grip; (iv) along the top surface of the upper fitting arm to the crest of the grip, with another ridge along the top surface of the lower fitting arm to the grip or the underside surface of the lower fitting arm to the lower end of the grip; or (v) along the top surface of the upper fitting arm to the crest of the grip, with two more ridges, one of the two along the top surface of the lower fitting arm to the grip and the other of the two along the underside surface of the lower fitting arm to the lower end of the grip, and that the connecting passages for air release are formed along the sides of this ridge or ridges.

3. The synthetic resin bottle with a handle according to claim 2 wherein the ridge has a cross-sectional shape of an inverted trapezoid in which lateral width is enlarged from base toward the top surface.

4. The synthetic resin bottle with a handle according to claim 1 wherein the groove is formed so that it extends rearward from behind the base of at least the stopper of either the upper fitting arm or the lower fitting arm: (i) along the top surface of the upper fitting arm to the crest of the grip; (ii) along the top surface of the lower fitting arm to the grip or the underside surface of the lower fitting arm to the lower end of the grip; (iii) along the top surface of the lower fitting arm to the grip and the underside surface of the lower fitting arm to the lower end of the grip; (iv) along the top surface of the upper fitting arm to the crest of the grip, with another groove along the top surface of the lower fitting arm to the grip or the underside surface of the lower fitting arm to the lower end of the grip; or (v) along the top surface of the upper fitting arm to the crest of the grip, with two more grooves, one of the two along the top surface of the lower fitting arm to the grip and the other side of the two along the underside surface of the lower fitting arm to the lower end of the grip, and that a connecting passage or passages for air release is/are formed through this groove or grooves.

5. A synthetic resin bottle with a handle comprising:

the synthetic resin bottle, which is a biaxially drawn, blow molded product and has a recessed portion disposed at the rear of a body of the bottle, and the synthetic resin handle, which is fitted in an undercut engagement to the above recessed portion by an insert molding process, said handle comprising:

an upper fitting arm and a lower fitting arm disposed respectively at an upper end and a lower end of a grip in a vertically long plate shape so that both arms extend forward from the grip, a stopper extending upward from a front end of the upper fitting arm, and a stopper extending upward and/or downward from a front end of the lower fitting arm, wherein a transverse ridge is formed at a position closely behind a base of at least the stopper of either the upper fitting arm or the lower fitting arm so that the transverse ridge extends to both sides of a fitting arm: (i) across a top surface of the upper fitting arm; (ii) across a top or underside surface of the lower fitting arm; (iii) across each of the top and underside surfaces of the lower fitting arm; (iv) across the top surface of the upper fitting arm, with another ridge across the top or underside surface of the lower fitting arm; or (v) across the top surface of the upper fitting arm, with two more ridges, one of the two being across the top surface of the lower fitting arm, and the other of the two being across the underside surface of the lower fitting arm, and wherein a groove for air release is formed beside this transverse ridge or ridges to connect to outside of the bottle so that pinholes, if any, can be detected.

6. The synthetic resin bottle with a handle according to claim 5 wherein the handle has a cross-section of an H-beam structure in which two plates are connected by a central rib, with this structure ranging from the upper fitting arm to the lower fitting arm with the grip in between, wherein both ends of the transverse groove are connected to both depressed side portions of the upper fitting arm or the lower fitting arm derived from the H-beam structure.

7. The synthetic resin bottle with a handle according to claim 6 wherein the transverse ridge is formed at a position closely behind the base of a stopper of either the upper fitting arm or the lower fitting arm so that the ridge extends laterally to both sides of the fitting arm: (i) across the top surface of the upper fitting arm; (ii) across the top or underside surface of the lower fitting arm; (iii) across each of the top and underside surface of the lower fitting arm; (iv) across the top surface of the upper fitting arm, with another ridge across the top or underside surface of the lower fitting arm; or (v) across the top surface of the upper fitting arm, with two more ridges, one of the two being across the top surface of the lower fitting arm, and the other of the two being across the underside surface of the lower fitting arm and that the groove for air release is formed beside this ridge.

* * * * *

UNITED STATES PATENT AND TRADEMARK OFFICE

CERTIFICATE OF CORRECTION

PATENT NO. : 8,851,312 B2
APPLICATION NO. : 12/593697
DATED : October 7, 2014
INVENTOR(S) : Junichi Itokawa et al.

It is certified that error appears in the above-identified patent and that said Letters Patent is hereby corrected as shown below:

In the Specification

Column 3, line 49: change “ridge along” to -- ridge or groove along --

Column 10, line 20: change “a of” to -- 6t of --

Column 12, line 28: change “lot” to -- 10t --

Signed and Sealed this
Twenty-fourth Day of February, 2015

Michelle K. Lee

Michelle K. Lee
*Deputy Director of the United States Patent and Trademark Office*